United States Patent [19]

Rice, III

[11] 4,408,893

[45] Oct. 11, 1983

[54] MOTIONLESS MIXING DEVICE

[75] Inventor: William T. Rice, III, Charlotte, N.C.

[73] Assignee: Luwa A.G., Zurich, Switzerland

[21] Appl. No.: 372,464

[22] Filed: Apr. 28, 1982

[51] Int. Cl.[3] ..... B01F 5/06

[52] U.S. Cl. ..... 366/339

[58] Field of Search ..... 366/336, 337, 338, 339, 366/341; 138/38, 42

[56] References Cited

U.S. PATENT DOCUMENTS

| | | | |
|---|---|---|---|
| 3,286,992 | 11/1966 | Armeniades | 366/339 |
| 3,664,638 | 5/1972 | Grout | 366/338 |
| 3,704,006 | 11/1982 | Grout | 210/758 |
| 3,888,465 | 6/1975 | Terwilliger | 366/339 |
| 3,953,002 | 4/1976 | England | 366/339 |
| 4,183,682 | 1/1980 | Lieffers | 366/339 |

*Primary Examiner*—Robert W. Jenkins

*Attorney, Agent, or Firm*—Richards, Shefte & Pinckney

[57] ABSTRACT

A motionless fluid mixing device having a tubular conduit in which right-hand and left-hand primary helical baffles are alternatingly arranged in spaced, serial relation with smaller helical connecting baffles extending centrally in the conduit between the primary baffles. The conduit has an entrance and exit end, each connecting baffle being helically curved oppositely to the primary baffle on the entrance end side of the connecting baffle for preventing center channeling of fluids flowing through the conduit by obstructingly deflecting and turbulently diffusing outwardly the portion of fluids flowing centrally in the conduit.

21 Claims, 5 Drawing Figures

MOTIONLESS MIXING DEVICE

BACKGROUND OF THE INVENTION

The present invention relates generally to devices for mixing a plurality of fluids and more particularly to such devices commonly characterized as "motionless" in that they employ no moving parts.

Conventional motionless mixing devices typically provide a tubular housing through which two or more fluids to be mixed are caused to flow, ordinarily under pressure, and in which housing a plurality of stationary helical baffle members are serially disposed for progressively dividing and subdividing the liquids to effect the mixing thereof. Representative examples of such motionless mixing devices are disclosed in U.S. Pat. Nos. 3,286,992; 3,664,638; and 3,704,006.

Mixing devices of this type have proved satisfactory for the mixing of fluids of approximately the same viscosity but have been found to perform unacceptably to mix fluids of widely varying viscosities because of the tendency of such fluids for laminar flow with the less viscous fluid flowing primarily centrally through the device where the baffles thereof have little mixing effect on such fluid, this effect being commonly referred to in the art as channeling. A lengthy mixing device or multiple mixing devices could be employed to achieve better intermixing of such fluids, but the attendant space requirements and cost of such a mixing arrangement would ordinarily be prohibitive.

This problem has been recognized in U.S. Pat. No. 3,953,002, which discloses the use of tapered cylindrical links spacing apart the several baffle members of an otherwise conventional mixer of the above-described type to disperse any fluid tending to channel centrally in the mixer. While this mixer provides an acceptable improvement over conventional mixers in achieving better mixing of fluids of differing viscosities, it nevertheless is generally incapable of mixing such fluids to the degree achieved by conventional mixers in mixing fluids of comparable viscosity.

In contrast, the present invention provides an improvement in the latter type motionless mixing device which is operable to turbulently diffuse outwardly from the center channel thereof the portion of fluids flowing therealong in a manner which is effective to achieve mixing of fluids of varying viscosities to a degree comparable to that achieved conventionally in mixing fluids of the same viscosity.

SUMMARY OF THE INVENTION

Briefly described, the present mixing device includes a body having formed therethrough a cylindrical bore havng a fluid entrance end and a fluid exit end for flow therethrough of fluids to be mixed. At least two oppositely-curved primary helical baffles are disposed longitudinally in the bore in axially spaced serial relation and respectively extend transversely across the bore to divide it, for successively dividing and oppositely turning the fluids as they flow therethrough. A connecting helical baffle of substantially smaller corresponding transverse dimension than the primary baffles extends longitudinally therebetween centrally in the bore and is curved oppositely of the primary baffle on the entrance end side of the connecting baffle. The connecting baffle accordingly is arranged to enhance the mixing of the fluids by obstructingly deflecting the portion of the fluids flowing centrally of the bore along the entrance end primary baffle for diffusingly turbulent redirection of such fluids portion in conjunction with dividing and turning of the fluids by the other primary baffle.

In the preferred embodiment, each of the primary baffles is curved helically along its length approximately 360 degrees and the primary baffles have substantially linear adjacent facing edges which extend transversely across the bore and are oriented substantially perpendicularly with respect to each other. The connecting helical baffle is curved along its length approximately 90 degrees and has substantially linear opposite end edges which are unitarily formed respectively with the adjacent facing edges of the primary baffles. Preferably, the transverse dimension of the connecting helical baffle is between 25% and 50% of that of each of the primary baffles and the longitudinal dimension of the connecting helical baffle is between 10% and 20% of the corresponding dimension of each of the primary baffles.

As desired and necessary to achieve a given degree of mixing, the device may be provided with a plurality of curved helical primary baffles arranged in the bore with alternate primary baffles being oppositely curved and with a connecting helical baffle extending between adjacent primary baffles.

DESCRIPTION OF THE PREFERRED EMBODIMENT

Figure 1:
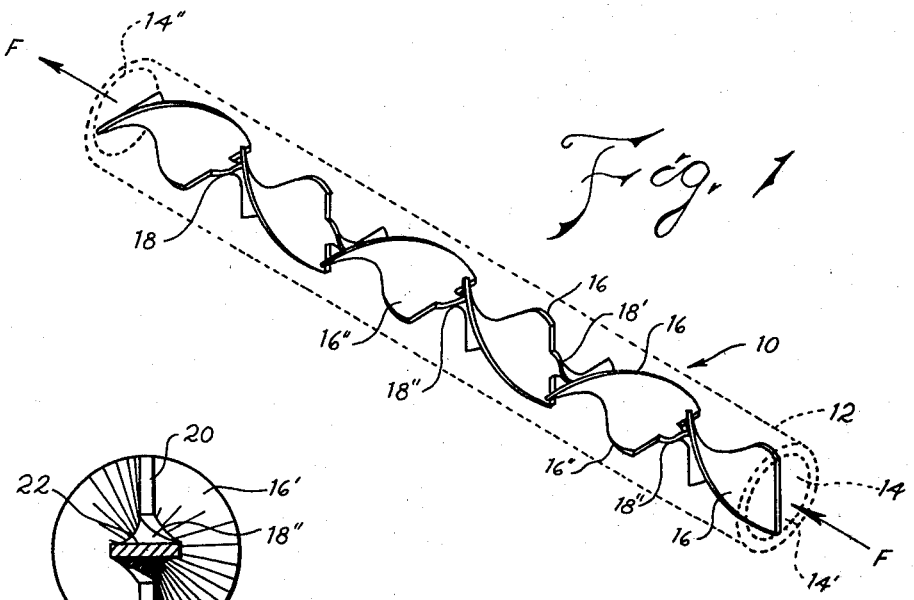
FIG. 1 is a perspective view of a motionless mixing device according to the preferred embodiment of the present invention.
Figure 4:
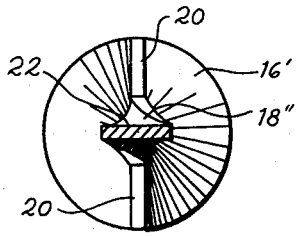
FIG. 4 is a vertical sectional view taken along line 4—4 of FIG. 2.
Figure 5:
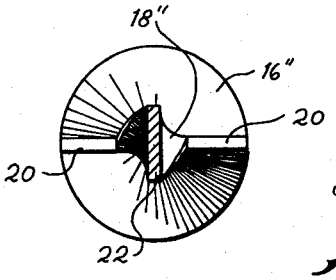
FIG. 5 is a vertical sectional view taken along line 5—5 of FIG. 2.
Figure 2:
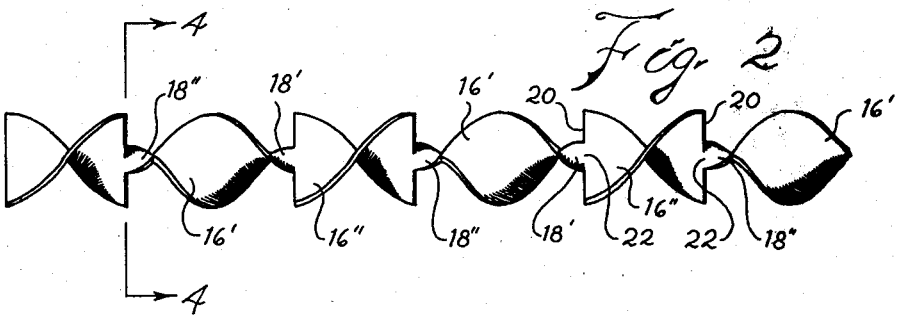
FIG. 2 is a side view of the device of FIG. 1.
Figure 3:
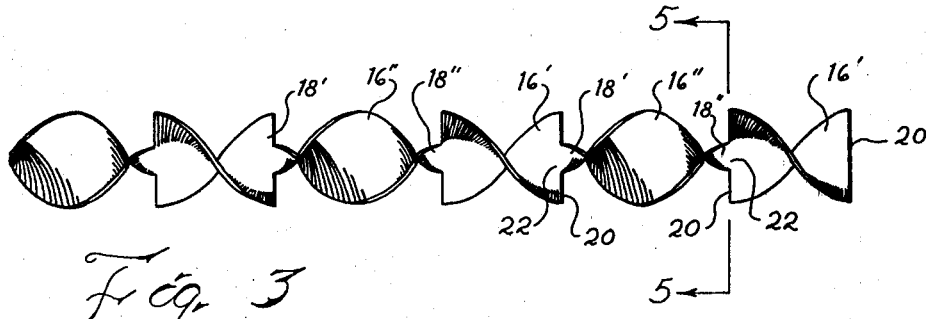
FIG. 3 is a top plan view of the device of FIG. 1.

Referring now to the accompanying drawings, a motionless mixing device according to the preferred embodiment of the present invention is indicated generally at 10 in FIG. 1. The device basically includes a tubular body or housing 12 through which is formed a cylindrical bore 14, a plurality of helical primary baffle members 16 arranged in the bore 14 in serial, equally-spaced relation along the bore's length, and a plurality of substantially smaller connecting helical baffles 18 extending centrally in the bore 14 between adjacent primary baffle members 16.

The primary baffles 16 are preferably formed of stainless steel or another non-corrosive metal as sheet-like elements each helically twisted between its opposite, substantially linear end edges 20 to curve approximately 360 degrees along its length and each baffle 16 having sufficient transverse dimension to extend across the bore 14 into side edgewise contact therewith along the baffle's entire length. One group of the baffles 16 is provided with a right-hand spiral turning (baffles 16') and another group of the baffles 16 have a left-hand spiral turning (baffles 16''). The connecting baffles 18 are of a construction similar to the primary baffles 16 but are of substantially smaller longitudinal and transverse dimensions than the primary baffles 16, the connecting baffles 18 being formed of stainless steel as sheet-like elements each helically twisted between its opposite, substantially linear end edges 22 to curve approximately 90 degrees along its length. Each connecting baffle 18 preferably is of a transverse dimension approximately 25% to 50% of the corresponding dimension of the primary baffles 16 and is of a longitudinal dimension approximately 10% to 20% of the corresponding dimension of the primary baffles 16. One group of the connecting baffles 18 is provided with a right-hand spiral turning (baffles 18') and another group of the connecting baffles 18 is provided with a left-hand spiral turning (baffles 18'').

The tubular housing 12 is adapted for flow of two or more fluids to be mixed through the bore 14 from its entrance end 14' to its exit end 14'', as indicated by directional arrows F. The right-hand and left-hand primary baffles 16',16'' are alternatingly arranged longitudinally in the bore 14 in axially-spaced serial relation along substantially the entire length of the bore 14 with the adjacent facing end edges 20 of adjacent baffles 16 being oriented substantially perpendicularly relative to each other. One connecting baffle 18 is disposed intermediately of adjacent primary baffles 16, the right-hand and left-hand connecting baffles 18',18'' being arranged alternatingly in reverse order to the alternation of the primary baffles 16',16'', such that an oppositely-curved connecting baffle 18 follows each primary baffle 16 in the direction of fluid flow F through the bore 14 from its entrance end 14' to its exit end 14''; that is, a right-hand connecting baffle 18' follows every left-hand primary baffle 16'' and a left-hand connecting baffle 18'' follows each right-hand primary baffle 16'. Each connecting baffle 18 extends longitudinally between its associated pair of adjacent primary baffles 16 centrally in the bore 14 with the opposite end edges 22 of the connecting baffle 18 respectively joined continuously therealong unitarily with the adjacent facing end.edges 20 of the associated adjacent primary baffles 16.

In operation, the fluids to be mixed are directed to flow, ordinarily under pressure, into the entrance end 14' of the bore 14 and pass successively against and over the helical primary and connecting baffles 16,18. As will be understood, the primary baffles 16 successively divide and spirally turn the flowing fluids, the perpendicular orientation of the edges of adjacent primary baffles 16 and the alternating arrangement thereof progressively dividing and sub-dividing the fluids while imparting thereto an alternatingly reversing spiraling motion to effect intermixing of the fluids in a conventional manner. It will also be understood, however, that, as a result of the configuration of the primary baffles 16, the portion of the fluids flowing centrally in the bore 14 does not flow spirally to any significant extent as compared to the portions of the fluids flowing through the bore 14 outwardly of its central area, and such "channeling" fluid portions will tend to continue to flow centally in the bore 14 without significantly mixing with the remainder of the fluids in the bore 14. The relatively small, oppositely-curving, helical connecting baffle 18 following each primary baffle 16 is effective to obstructingly deflect and impart reversed spiral motion to the portion of the fluids flowing centrally in the bore 14 along the preceding primary baffle 16, thereby creating turbulence at the ordinarily calm central channel of the bore 14 which is effective to substantially redirect diffusingly outwardly therefrom such portion of the fluids flowing centrally in the bore 14 along the preceding primary baffle 16 whereby such fluids portion will be divided and spirally turned by the succeeding primary baffles 16 to enhance the mixing of the fluids. It is importantly to be noted in this regard that the present mixing device, in substantial contrast to conventional devices, requires that fluids to be mixed must flow through the bore 14 in a particular direction, ie. from the entrance end 14' to the exit end 14'', to achieve this result, conventional mixing devices being equally operable with fluids flowing therethrough in either direction. Those skilled in the art will readily recognize that this device will provide significantly improved mixing of fluids of widely varying viscosities by preventing the center channeling of the less viscous fluid. However, it is to be understood that the present mixing device is equally applicable for the mixing of fluids of the same viscosity or of other fluids.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. A device for intermixing a plurality of fluids comprising a body having formed therethrough a cylindrical bore having a fluid entrance end and a fluid exit end for flow therethrough of said fluids, two oppositely-curved primary helical baffles disposed longitudinally in said bore in axially spaced relation and respectively extending transversely across said bore to divide it for successively dividing and oppositely turning said fluids as they flow therethrough, and a connecting helical baffle of substantially smaller corresponding transverse dimension than said primary baffles extending longitudinally therebetween centrally in said bore and being curved oppositely of the primary baffle on the entrance end of said connecting baffle to obstructingly deflect the portion of said fluids flowing centrally of said bore along said entrance end primary baffle for diffusingly turbulent redirection of said fluids portion in conjunction with dividing and turning of said fluids by the other primary baffle, thereby enhancing the mixing of said fluids.

2. A device for intermixing a plurality of fluids according to claim 1 and characterized further in that said two primary baffles have adjacent facing edges which extend transversely across said bore and are oriented angularly with respect to each other, said connecting helical baffle having opposite end edges respectively joined continuously therealong to said adjacent facing edges of said primary baffles.

3. A device for intermixing a plurality of fluids according to claim 2 and characterized further in that each of said primary baffles is curved helically along its length approximately 360 degrees, said adjacent facing edges thereof being substantially linear and oriented substantially perpendicularly.

4. A device for intermixing a plurality of fluids according to claim 3 and characterized further in that said connecting helical baffle is curved along its length approximately 90 degrees, said opposite end edges thereof being substantially linear and being unitarily formed respectively with said adjacent facing edges of said primary baffles.

5. A device for intermixing a plurality of fluids according to claim 4 and characterized further in that the longitudinal dimension of said connecting helical baffle is between 10% and 20% of the corresponding dimension of each of said primary baffles.

6. A device for intermixing a plurality of fluids according to claim 1 or 3 and characterized further in that the transverse dimension of said connecting helical baffle is between 25% and 50% of the corresponding dimension of each of said primary baffles.

7. A device for intermixing a plurality of fluids according to claim 1 and characterized further in that the longitudinal dimension of said connecting helical baffle is between 10% and 20% of the corresponding dimension of each of said primary baffles.

8. A device for intermixing a plurality of fluids comprising a tubular housing having formed therethrough a cylindrical bore having a fluid entrance end and a fluid exit end for flow therethrough of said fluids, a plurality of curved primary helical baffles disposed longitudinally in said bore in axially-spaced serial relation with alternate primary baffles being oppositely curved and each said primary baffle having transverse opposite end edges and extending transversely across said bore intermediately of its said end edges to divide said bore, the facing adjacent end edges of adjacent primary helical baffles being oriented angularly with respect to each other, for successively progressive dividing and turning and sub-dividing and oppositely turning of said fluids as they flow through said bore, and a plurality of connecting helical baffles of substantially smaller transverse dimension than said primary baffles, one said connecting baffle being joined to and extending longitudinally centrally in said bore between the angularly-oriented adjacent facing edges of adjacent primary baffles and each said connecting baffle being curved oppositely of the primary baffle on the entrance end side of said connecting baffle, to obstructingly deflect the portion of said fluids flowing centrally of said bore along each primary baffle for diffusingly turbulent redirection of said fluids portion in conjunction with dividing and turning of said fluids by successive primary baffles, thereby enhancing the mixing of said fluids.

9. A device for intermixing a plurality of fluids according to claim 8 and characterized further in that each said connecting helical baffle has opposite end edges respectively joined continuously therealong to said adjacent facing edges of its associated primary baffles.

10. A device for intermixing a plurality of fluids according to claim 9 and characterized further in that each of said primary baffles is curved helically along its length approximately 360 degrees, said adjacent facing edges thereof being substantially linear and oriented substantially perpendicularly.

11. A device for intermixing a plurality of fluids according to claim 10 and characterized further in that each said connecting helical baffle is curved along its length approximately 90 degrees, said opposite end edges thereof being substantially linear and being unitarily formed respectively with said adjacent facing edges of said primary baffles associated with said connecting helical baffle.

12. A device for intermixing a plurality of fluids according to claim 8 or 11 and characterized further in that the transverse dimension of each said connecting helical baffle is between 25% and 50% of the corresponding dimension of each of said primary baffles.

13. A device for intermixing a plurality of fluids according to claim 12 and characterized further in that the longitudinal dimension of each said connecting baffle is between 10% and 20% of the corresponding dimension of each of said primary baffles.

14. A device for intermixing a plurality of fluids according to claim 8 and characterized further in that the longitudinal dimension of each said connecting baffle is between 10% and 20% of the corresponding dimension of each of said primary baffles.

15. An improved baffle apparatus for disposition in a cylindrical bore of a mixing device body through which bore fluids to be mixed flow between an entrance end and an exit end of the bore, said apparatus comprising two oppositely-curved primary helical baffles arranged longitudinally in co-axial spaced relation and being of a transverse dimension sufficient to extend transversely across the bore to divide it, and a connecting helical baffle of substantially smaller corresponding transverse dimension than said primary baffles extending longitudinally co-axially therebetween and being curved oppositely to one said primary baffle, said apparatus being adapted for disposition in said bore with said one primary baffle most closely adjacent said entrance end such that said primary baffles successively divide and oppositely turn said fluids as they flow through the bore and said connecting baffle obstructingly deflects the portion of said fluids flowing centrally of said bore along said one primary baffle for diffusingly turbulent redirection of said fluids portion in conjunction with dividing and turning of said fluids by the other primary baffle, thereby to enhance the mixing of said fluids.

16. An improved baffle apparatus according to claim 15 and characterized further in that said two primary baffles have adjacent facing edges and are oriented angularly with respect to each other, said connecting helical baffle having opposite end edges respectively joined continuously therealong to said adjacent facing edges of said primary baffles.

17. An improved baffle apparatus according to claim 16 and characterized further in that each of said primary baffles is curved helically along its length approximately 360 degrees, said adjacent facing edges thereof being substantially linear and oriented substantially perpendicularly.

18. An improved baffle apparatus according to claim 17 and characterized further in that said connecting helical baffle is curved along its length approximately 90 degrees, said opposite end edges thereof being substantially linear and being unitarily formed respectively with said adjacent facing edges of said primary baffles.

19. An improved baffle apparatus according to claim 15 or 18 and characterized further in that the transverse dimension of said connecting helical baffle is between 25% and 50% of the corresponding dimension of each of said primary baffles.

20. An improved baffle apparatus according to claim 19 and characterized further in that the longitudinal dimension of said connecting helical baffle is between 10% and 20% of the corresponding dimension of each of said primary baffles.

21. An improved baffle apparatus according to claim 15 and characterized further in that the longitudinal dimension of said connecting helical baffle is between 10% and 20% of the corresponding dimension of each of said primary baffles.

* * * * *